United States Patent [19]

Ghosh

[11] Patent Number: 4,847,044

[45] Date of Patent: Jul. 11, 1989

[54] METHOD OF FABRICATING A METAL ALUMINIDE COMPOSITE

[75] Inventor: Amit K. Ghosh, Thousand Oaks, Calif.

[73] Assignee: Rockwell International Corporation, El Segundo, Calif.

[21] Appl. No.: 182,676

[22] Filed: Apr. 18, 1988

[51] Int. Cl.[4] ..... B22F 7/00

[52] U.S. Cl. ..... 419/8; 228/193; 228/195; 228/263.12; 228/263.17; 419/10; 419/11; 419/12; 419/17; 419/19; 419/24; 419/48; 419/49; 428/552; 428/553; 428/549; 428/556; 428/654

[58] Field of Search ..... 419/8, 10, 11, 12, 17, 419/19, 24, 48, 49; 228/193, 195, 263.12, 263.17; 428/552, 553, 556, 654, 549

[56] References Cited

U.S. PATENT DOCUMENTS

| | | | |
|---|---|---|---|
| 3,918,925 | 11/1975 | McComas | 75/229 |
| 4,019,874 | 4/1977 | Moskowitz | 75/241 |
| 4,292,079 | 9/1981 | Pickens et al. | 75/232 |
| 4,297,136 | 10/1981 | Pickens et al. | 75/234 |
| 4,650,519 | 3/1987 | Chang et al. | 75/246 |
| 4,676,829 | 6/1987 | Chang et al. | 75/246 |

*Primary Examiner*—Stephen J. Lechert, Jr.

*Attorney, Agent, or Firm*—H. Fredrick Hamann; Craig O. Malin

[57] ABSTRACT

A softer metal such as aluminum, or a metal forming a metal aluminide, or an alloy containing these metals is added to a metal aluminide composite during fabrication to promote easy consolidation of the metal aluminide matrix with the reinforcing phase. The metal aluminide may be titanium aluminide, nickel aluminide, or iron aluminide. The softer metal, the metal aluminide matrix, and the reinforcing phase are pressed together at a temperature above the softening temperature of the softer metal. The softened metal promotes flow and consolidation of the matrix and the reinforcement at relatively low temperatures. The composite is held at an elevated temperature to diffuse and convert the soft metal phase into the metal aluminide matrix. By consolidating at a lower temperature, cracking tendencies due to thermal expansion differences between the matrix and reinforcement is reduced. By consolidating at a lower pressure, mechanical damage to the fibers is avoided.

11 Claims, 2 Drawing Sheets

METHOD OF FABRICATING A METAL ALUMINIDE COMPOSITE

BACKGROUND OF THE INVENTION

This invention relates to the field of composite structural materials, and particularly to metal matrix composite materials.

Performance requirement goals for future advanced airframe structures and gas turbine engines exceed the capabilities and limits of currently available materials and manufacturing technologies. Improvements in lightweight, high-temperature materials and processes are required to meet the challenging goals. Metal aluminides, particularly titanium aluminide base alloys, offer opportunities for weight reduction compared to nickel base superalloys. To achieve the ambitious high temperature capability goal in a light and stiff material, it has been proposed to fabricate fiber-reinforced composites using titanium aluminide base alloys as the matrix. However, as high strength and high temperature matrix materials are selected to provide high performance composites, it becomes more difficult to fabricate the composites because the temperatures and pressures required to consolidate the materials also increase.

Composites can be fabricated by placing a reinforcing material such as silicon carbide fibers between foils of a matrix material such as a metal alloy. These ingredients are then consolidated into a composite by pressing them together at a temperature and pressure which will cause the matrix to flow around the reinforcing fibers and diffusion bond the matrix together.

An alpha titanium aluminide ($Ti_3Al$) base alloy is currently available (Ti-24Al-11Nb, atomic %). Alloys using other titanium aluminides (gamma-TiAl and near delta-$TiAl_3$) and using other metals to form the aluminide such as nickel aluminide and iron aluminide are also under development. Many reinforcing phases are also available in the form of fibers, powders, and whiskers made from silicon carbide, alumina, graphite, boron and other materials. Some of these reinforcing phases have surfaces which are modified to promote their incorporation into metal matrix composites. For example, a silicon carbide fiber was modified with the goal of withstanding the thermal exposure required to consolidate and form titanium matrix composites ("A Review of SiC Filament Composite Production and Fabrication Technology", J. A. Cornie, Fourth Metal Matrix Composites Technology Conference, Proceedings, MMCIAC-Kaman Tempo, Santa Barbara, Calif., pgs. 30-1 though 30-9, 1982). It has however been found that this C-rich outer layer (SCS-6) does not prevent chemical reaction with the matrix, but protects the CVD SiC fiber from notching and damage.

In order to obtain a sound composite with optimum mechanical properties, it is necessary to consolidate the matrix with the reinforcement phase without leaving cracks and voids in the composite, and without damaging the reinforcement by mechanical stress and by formation of brittle phases due to chemical reaction with the matrix at the consolidation temperature. This is a particular problem when high strength matrices such as titanium aluminide alloys are used with reinforcing materials which are brittle and which tend to react chemically with the matrix material.

FIG. 1 is a photomicrograph of a prior art composite showing voids 2 between the reinforcing phase 4. During consolidation, the matrix material 6 was unable to flow between the closely spaced reinforcing fibers, and consequently voids were left. Such voids can reduce the integrity of structures made from the composite. Attempts to fill such voids by increasing the temperature and pressure of consolidation can cause other problems such as fiber breaking or chemical reaction of the reinforcing fibers with the matrix.

SUMMARY OF THE INVENTION

It is an object of the invention to provide a method of fabricating a metal aluminide matrix composite which can be consolidated at lower temperatures and/or pressures than prior art methods for composites having a similar matrix and reinforcing phase.

It is an object of the invention to provide a method of fabricating a metal aluminide matrix composite having improved structural integrity.

It is an object of the invention to provide a method of fabricating a metal aluminide matrix composite which minimizes mechanical damage of the reinforcing phase.

It is an object of the invention to provide a method of fabricating a metal aluminide matrix composite which minimizes chemical reaction between the matrix and the reinforcing phase.

According to the invention, a softer metal which can be aluminum, or can be the metal constituting the metal ingredient of the metal aluminide, or can be an alloy containing at least one of these two metals is added with the fiber and metal aluminide matrix during composite fabrication to promote easier consolidation of the metal aluminide alloy matrix with the reinforcing phase. During consolidation, the softer metal, the metal aluminide alloy matrix, and the reinforcing phase are pressed together at a temperature above the softening temperature of the added metal. The softened metal promotes flow and consolidation of the matrix with the reinforcement at temperatures and/or pressures below those normally required to cosolidate the metal aluminide matrix.

The added metal may then be converted into a metal aluminide and become a part of the matrix. This is accomplished by simply heating the composite either as a part of the consolidation or as a separate step after consolidation. This matrix changes in accordance with the binary phase diagram which shows the existence of the metal aluminides depending upon the composition and temperature. In this manner the added metal can be eliminated completely as a distinctly separate phase in the composite. Even when this phase is not completely eliminated, it might serve to impart crack retardation properties to the composite, by virtue of its higher ductility.

These and other objects and features of the invention will be apparent from the following detailed description taken with reference to the accompanying drawings.

DESCRIPTION OF THE INVENTION

Figure 1:
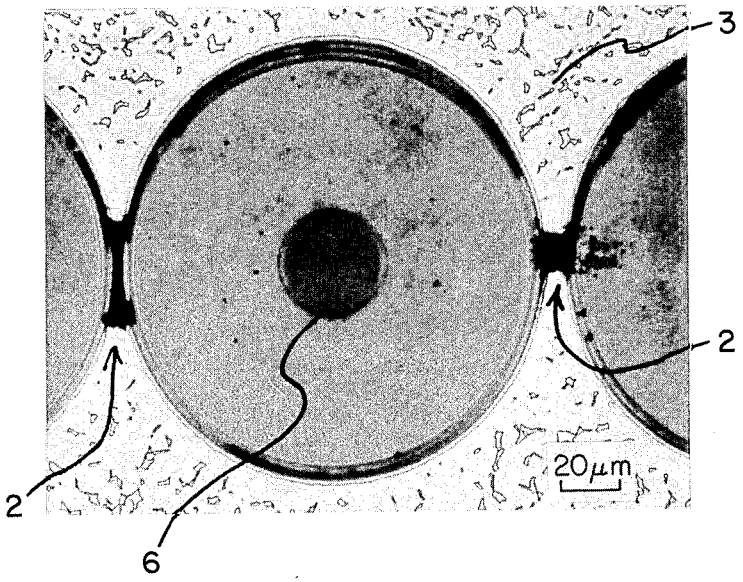
FIG. 1 PRIOR ART
FIG. 1 is a photomicrograph of a cross section of a prior art composite showing voids in the matrix between the closely spaced reinforcing fibers.

It has been discovered that consolidation of a titanium aluminide matrix composite can be facilitated by including a softer metal such as aluminum (or titanium) in contact with the titanium aluminide during the consolidation process. Consolidation is done under a relatively low pressure at a temperature near or above the melting temperature of the aluminum. Because the aluminum undergoes at least partial melting, matter transport is rapid through the liquid phase until composition changes lead to a significant rise in the melting temperature. The aluminum can be added as a foil between the reinforcing material and the matrix material, or it can be added as a powder mixed with a powdered matrix material, or as a powder or coating applied between the reinforcing material and the matrix.

The advantages gained by using the softer metal additive are the following: Softer metal allows easy matrix filling between closely spaced fibers. Additionally, the lower consolidation temperatures used in this process help to maintain lower cooling induced stresses in the matrix, which arise from the coefficient-of-thermal-expansion difference between the matrix and the reinforcement. This, in turn, minimizes cracking of the matrix between closely spaced fibers. The lower consolidation pressures used in the process avoid mechanical damage to the fibers.

Diffusion during consolidation promotes compositional equilibrium between the added aluminum and the titanium aluminide matrix material. Once consolidation is achieved, static annealing can be used to allow compositional equilibrium by further diffusion to form titanium aluminides as shown by the standard Ti-Al binary phase diagram. Either aluminum, titanium, or alloys containing aluminum and/or titanium such as 6061 and Ti-6Al-4V can be used as the softer metal because these metals can form titanium aluminide intermetallic compounds in accordance with the relationship shown in the binary phase diagram. In the case of a soft phase, e.g. Ti-6Al-4V, which has a very high melting temperature, consolidation temperature exceeds only its softening temperature, not its melting temperature. Consolidation occurs, therefore, via solid state flow of this phase.

In a preferred embodiment, matrix used for the composite is an alloy containing titanium aluminide. As shown in Table I, three such intermetallic compounds exist. Much work has been done on the alpha-two ($\alpha_2$) aluminide, and an alloy incorporating alpha-two aluminide has been produced (Ti-24%Al-11%Nb, in atomic %). As shown in Table I, the gamma and near delta titanium aluminides have even higher temperature capabilities. Alloys incorporating any of these intermetallic compounds with other alloying ingredients such as niobium, vanadium, molybdenum, and erbium are suitable as the matrix-forming constituent of the invention because they provide the titanium aluminide for combining with the softer aluminum or titanium additive.

TABLE I

High-Temperature Titanium Aluminides

| | $Ti_3Al$ (alpha) | TiAl (gamma) | $TiAl_3$ (near delta) |
|---|---|---|---|
| Density, lb/cubic inch | 0.15 | 0.14 | 0.12 |
| Maximum Temperature Creep, F. | 1400 | 1700 | 1600 |
| Ductility (RT) % | 2 | 1 | ½ |
| Modulus, million psi | 21 | 25 | 25 |

Other embodiments of the invention use either nickel aluminides or iron aluminides to form the matrix of the composite. These aluminides are analogous to the titanium aluminides and the composite can be fabricated by a method analogous to the method for fabricating titanium aluminide composites. For nickel aluminides, the accommodating metal is either nickel or aluminum. For iron aluminides, the accommodating metal is either iron or aluminum.

Numerous reinforcing materials are available and are continuously being developed for fabricating composites. Table I lists currently available reinforcing fibers which can be used to fabricate composites according to the invention. Selection of a particular fiber depends upon the properties required in the particular composite, the compatibility of the fiber with the matrix material during fabrication and during use of the composite, and other considerations within the skill of the artisan or within his ability to conduct empirical tests.

TABLE II

Reinforcing Fibers

| Fiber | Melting or Softening Point (°F.) | Density, $\rho$ (lb/in.$^3$) | Tensile Strength $\sigma$($10^3$psi) | Specific Strength, $\sigma/\rho$ ($10^4$g in.) | Young's Modulus, E ($10^6$psi) | Specific Modulus $E/\rho$ ($10^6$g in.) | Typical Cross Section ($\mu$m) |
|---|---|---|---|---|---|---|---|
| Graphite | 5000 | 0.073 | 350 | 4.8 | 70–100 | 1000–1400 | 9 |
| $Al_2O_3$ | 3700 | 0.114 | 300 | 2.6 | 30–35 | 400 | 10 |
| B | 4170 | 0.095 | 400 | 4.2 | 55 | 478 | 100 |
| $B_4C$ | 4400 | 0.085 | 330 | 3.9 | 70 | 824 | — |
| SiC | 4870 | 0.125–0.127 | 350 | 2.8 | 60 | 480 | 100–150 |
| SiC on B | 4170 | ~0.1 | 400 | ~4.0 | 55 | ~550 | 108 |

Examples of the method of the invention which have been used, or which can be used, to fabricate a titanium aluminide matrix composite are given below. The first example, a prior art approach to forming a composite, is given to serve as a comparison with the method of the invention as illustrated in the remaining examples.

EXAMPLE I PRIOR ART

SiC fibers 0.0056 in diameter were used as the reinforcing phase. These fibers are produced by the AVCO Corporation and are identified as SCS-6 fibers. They are produced by growing SiC on a graphite filament, and consequently the fibers have a graphite core. Foils of a 0.007 inch thick alpha titanium aluminide ($Ti_3Al$) alloy were used as the matrix. The alloy contained 11 atomic % niobium, 24 atomic % aluminum, balance titanium and is known as Ti-24Al-11Nb alloy. It is a two phase alloy with a $Ti_3Al$ ($\alpha_2$) phase and a niobium enriched $\beta$ titanium phase.

After cleaning and degreasing the SiC fibers and cleaning and sanding the Ti-24Al-11Nb foil, the fibers were closely spaced in a parallel manner and were sandwiched between layers of the foil. SiC fibers are also woven as a mat with Ti-6Al-4V or other cross weave fibers to provide a uniformly spaced parallel fiber arrangement. These are more readily incorporated in a composite pack. The pack was then placed between flat and parallel Inconel plates, using $Al_2O_3$ parting sheets in between. The entire pack was placed in a stainless steel bag using either flowing argon, static argon, or vacuum to provide a protective atmosphere.

The bag with its enclosed pack was held in a press for three hours at a temperature of 982° C. (1800° F.) and at a pressure of 15,000 psi. These conditions caused the matrix alloy to flow around the fibers and consolidated the composite. However, the matrix did not flow completely around the fibers causing voids in the very narrow spaces between the fibers.

FIG. 1 is a photomicrograph of a cross section of a portion of the composite. Voids 2 are evident in matrix 3 between SiC fibers 4. At the consolidation temperature and pressure used, matrix 3 did not have sufficient softness to flow completely between the closely spaced fibers 4. Additional cracking observed here result from thermal stresses arising during cooling. Core 6 is the graphite filament which is used to manufacture the SCS-6 fiber.

EXAMPLE II PRESENT INVENTION

A pack was assembled as described above for Example I except that 0.006 inch thick foil of 1100 alluminum was placed between the SiC fibers and the titanium aluminide alloy foil. The bag containing the pack was inserted into a press and heated at 680° C. at a pressure of 500 psi for 90 minutes.

Figure 2:
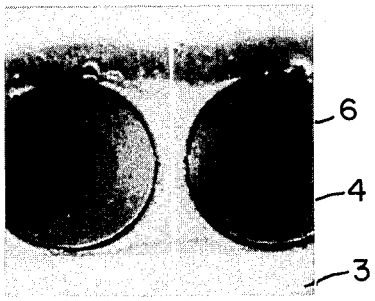
FIG. 2 is a photomicrograph of a cross section of a composite according to the invention showing complete penetration of the matrix between the closely spaced reinforcing fibers when metal foils are used to fabricate the composite.

FIG. 2 is a photomicrograph of a cross section of the composite fabricated per Example II. Note that there is complete flow and bonding of matrix 3 between fibers 4. There is some composition gradient as shown by the different shade of the matrix near the fibers, but this could be eliminated or at least reduced by using a thinner foil and/or by adding a static anneal as described below for Example III.

EXAMPLE III PRESENT INVENTION

In order to reduce the compositional gradient observed in Example III, changes in the process can be made to promote diffusion and obtain a more uniform matrix composition. This could be accomplished by using a thinner foil of aluminum such as a 0.002 inch thick foil. The bag containing the pack as described above (except with the thinner aluminum foil) is inserted into a press preheated to 660° C. and 5,000 psi pressure is applied. Prior to this, the inert environment within the bag is improved by argon purging and vacuum development several times followed by maintaining a vacuum level of $10^{-6}$ torr. Gradually the temperature is raised to 770° C. and held until all excess molten aluminum is rejected. Pressure is then increased to 10,000 psi and held for 70 minutes. Diffusion takes place aided by pressure during this time to produce a sound interfacial bond. Because the consolidation temperature is well below 900° C., interfacial reactions to produce brittle phases is avoided.

EXAMPLE IV PRESENT INVENTION

Figure 3:
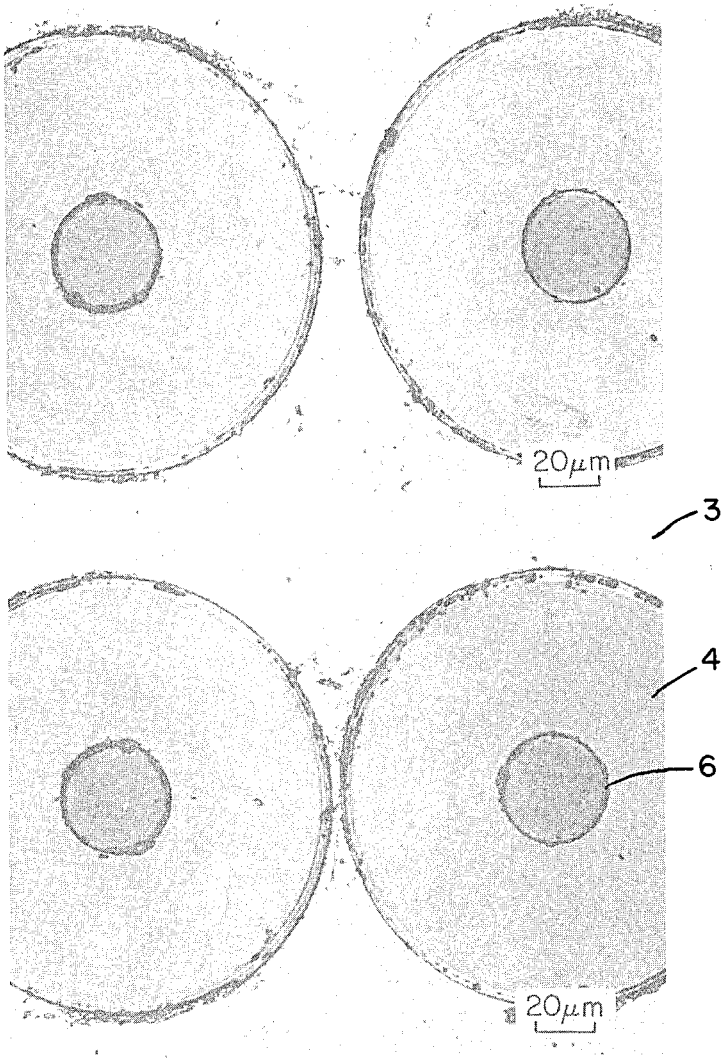
FIG. 3 is a photomicrograph of a cross section of a composite according to the invention showing complete penetration of the matrix between the closely spaced reinforcing fibers when metal powders are used to fabricate the composite.

The softer metal can be added in the form of a powder rather than as a foil as described in the above examples. Additionally, the titanium aluminide alloy which forms the matrix can also be added in the form of a powder. A composite has been fabricated by mixing 10 to 15% by weight of aluminum powder with a powdered alpha-two titanium aluminide alloy (Ti-14Al-21Nb). To facilitate mixing and ease of flow between fibers, it is advantageous to use very fine powder (−325 mesh). The silicon carbide reinforcing material in the form of a fiber mat was covered uniformly with the mixture of powders. This pack was then consolidated as described for Example III. The result was a matrix which could completely fill the narrow spaces between the silicon carbide fibers as shown in FIG. 3. No thermal stress induced cracking is seen either.

EXAMPLE V PRESENT INVENTION

The softer metal can be titanium rather than aluminum when the matrix is a titanium aluminide alloy. When titanium is used, the matrix composition is adjusted toward the titanium rich intermetallic ($Ti_3Al$ or TiAl) rather than toward the aluminum rich intermetallic ($TiAl_3$). The titanium can be added as a foil or powder and consolidated as described above except that a softening temperature of the titanium rather than its melting temperature is used. Suitable softening temperatures can be selected based upon published elevated temperature properties of titanium or by empirical tests.

EXAMPLE VI PRESENT INVENTION

The softer metal can be an alloy rather than a pure metal. When the matrix is a titanium aluminide alloy, a Ti-6Al-4V powder alloy or a powder titanium alloy of similar softness such as Ti-15V-3Al-3Sn-3 Cr alloy may be used as the softer metal. This powder is mixed with a $TiAl_3$ alloy powder as a starting alloy to form the matrix of the composite. A matrix composition in the finished composite that is close to the TiAl (gamma titanium aluminide) can be achieved. This is accomplished by diffusing the titanium-rich, softer alloy into the $TiAl_3$ alloy powder at a temperature of about 900° C. This heat treating diffusion step can be accomplished at the end of the consolidation step or by a separate heat treatment after removing the consolidated pack from the press.

EXAMPLE VII PRESENT INVENTION

Nickel aluminides and iron aluminides which are analogous to the titanium aluminides described above are also available. Composites of nickel aluminides or iron aluminides and reinforcing material can be fabricated in a manner analogous to examples II to VI above. The accommodating metal can be aluminum, the metal (nickel or iron) forming the aluminide, or an alloy containing at least one of these metals. A nickel or iron aluminide is used rather than a titanium aluminide to form the matrix of the composite.

The preferred embodiments of this invention have been illustrated and described above. Modifications and additional embodiments, however, will undoubtedly be apparent to those skilled in the art. For example, hot isostatic pressing can be used to consolidate the composite. Consequently, the exemplary embodiments should be considered illustrative, rather than inclusive, while the appended claims are more indicative of the full scope of the invention.

What is claimed is:

1. A method of fabricating a metal aluminide composite comprising:

providing a reinforcing phase;

providing a metal aluminide alloy;

providing a metal softer than the metal aluminide selected from the group consisting of aluminum, aluminum-base alloys, a metal constituent of the metal aluminide, and an alloy of the metal constituent;

placing the softer metal in contact with the reinforcing phase;

placing the metal aluminide alloy in contact with the softer metal;

pressing the reinforcing phase, the softer metal, and the metal aluminide alloy together while at a temperature above the softening temperature of the softer metal.

2. The method as claimed in claim 1 including the step of holding the composite at an elevated temperature sufficient to cause diffusion and conversion of the softer metal into the metal aluminide alloy.

3. The method as claimed in claim 1 wherein the reinforcing phase is selected from the group consisting of SiC, B, $TiB_2$, $Al_2O_3$, graphite, and boron carbide coated fibers of boron.

4. The method as claimed in claim 1 wherein the reinforcing phase comprises SiC fibers.

5. The method as claimed in claim 1 wherein the softer metal is a foil of metal.

6. The method as claimed in claim 1 wherein the softer metal is a powder metal.

7. The method as claimed in claim 1 wherein the metal aluminide alloy is a titanium aluminide alloy selected from the group consisting of $Ti_3Al$, TiAl, and $TiAl_3$.

8. The method as claimed in claim 1 wherein the metal aluminide alloy is a nickel aluminide alloy selected from the group consisting of $Ni_3Al$ and NiAl.

9. The method as claimed in claim 1 wherein the step of pressing comprises hot isostatic pressing.

10. The method as claimed in claim 7 wherein the softer metal is selected from the group consisting of Ti-6Al-4V alloy and Ti-15V-3Al-3Sn-3Cr alloy.

11. The method as claimed in claim 1 wherein the metal aluminide alloy is an iron aluminide alloy.

* * * * *